United States Patent [19]

Scott et al.

[11] 4,430,853

[45] Feb. 14, 1984

[54] HIGH TEMPERATURE RESISTANT SEWING THREAD AND METHOD OF FORMING SAME

[75] Inventors: Eddie W. Scott, Mebane; Errol N. Seltzer, Greensboro, both of N.C.

[73] Assignee: Collins & Aikman Corporation, New York, N.Y.

[21] Appl. No.: 323,242

[22] Filed: Nov. 20, 1981

[51] Int. Cl.[3] ..... D01H 13/26; D01H 3/00

[52] U.S. Cl. ..... 57/247; 57/250; 57/295; 57/903; 57/908; 57/351

[58] Field of Search ..... 57/237, 227, 239, 241, 57/243, 245, 246, 250, 258, 282, 286, 292, 295, 351, 903, 908

[56] References Cited

U.S. PATENT DOCUMENTS

| | | | |
|---|---|---|---|
| Re. 29,572 | 3/1978 | Usdan | 57/247 |
| 3,041,816 | 7/1962 | Stuewer | 57/236 |
| 3,150,481 | 9/1964 | Bilsky et al. | 57/250 X |
| 3,879,928 | 4/1975 | Usdan | 57/250 X |
| 4,004,329 | 1/1977 | London et al. | 28/1.4 |
| 4,011,640 | 3/1977 | Keith | 28/1.4 |
| 4,016,715 | 4/1977 | London | 57/247 |
| 4,069,564 | 1/1978 | Trifunovic et al. | 28/273 |

FOREIGN PATENT DOCUMENTS

| | | | |
|---|---|---|---|
| 2025142 | 2/1977 | Japan | 57/250 |
| 4006939 | 1/1979 | Japan | 57/250 |

*Primary Examiner*—Donald Watkins

*Attorney, Agent, or Firm*—Bell, Seltzer, Park & Gibson

[57] ABSTRACT

In accordance with the invention there is provided a synthetic sewing thread of multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns. The thread comprises a plurality of texturized continuous synthetic filaments, the filaments having a nonlinear crimped configuration providing bulk to the thread and being entangled with one another along the length of the thread and being further bound together by twist. The thread has a heat protective lubricant coating applied thereto and penetrating the filament bundle.

12 Claims, No Drawings

HIGH TEMPERATURE RESISTANT SEWING THREAD AND METHOD OF FORMING SAME

FIELD AND BACKGROUND OF THE INVENTION

This invention pertains to improvements in sewing thread, and more particularly to an improved continuous multifilament synthetic sewing thread which is characterized by the ability to withstand the relatively high temperatures generated by high speed industrial sewing machines.

Sewing threads formed of continuous multifilament synthetic yarns are known and have been used heretofore in certain sewing applications. This type of thread construction is generally less expensive to produce than sewing threads of conventional spun or corespun construction. However, the continuous multifilament sewing threads heretofore available have had certain inherent limitations which have limited their usefulness to a limited range of specific, relatively non-demanding applications. For example, when such threads are sewn into a seam, they generally present a relatively shiny appearance quite different from that presented by sewing threads of a spun yarn or corespun construction. Such an appearance is unacceptable in many types of garments where the appearance of the stitch is highly important. Additionally, in seams formed with continuous multifilament sewing threads, individual filaments sometimes tend to separate from the remainder of the filament bundle, presenting an unacceptable fuzzy appearance. Another very significant limitation of the continuous multifilament sewing threads heretofore available has been that such threads have been incapable of withstanding any significant level of heat generated during the sewing operation. Consequently, such threads have been used primarily on lightweight fabrics and in applications where little heat is generated.

Perhaps one of the most demanding applications for a sewing thread is in the sewing of relatively heavy weight fabrics, e.g. bottom weight fabrics such as denims or corduroys. In forming seams in garments of such fabrics, it may be necessary to sew through as many as four to six plies of fabric. At the high speeds used in industrial sewing operations, very high temperatures are produced at the sewing needle when sewing such fabrics. The needle temperature may rise for example to 500 to 600 degrees F. or higher, sufficient to melt a synthetic sewing thread. In attempting to deal with the problems presented by such high needle temperatures, various efforts have been undertaken, such as directing compressed air at the needle for cooling, as well as various special needle designs specifically intended for cooling. Because of the extreme heat at the needle, bottom weight fabrics are typically sewn with a sewing thread of cotton sheathed corespun construction on the needle. On the looper, where the temperature is not as severe, threads of conventional cotton spun yarn construction are typically used. Synthetic sewing threads of a continuous multifilament construction have heretofore been unsuitable for use in these applications because of the inability to withstand the needle heat which is generated.

SUMMARY OF THE INVENTION

With the foregoing in mind, it is an important object of the present invention to provide an improved continuous multifilament sewing thread which is capable of withstanding the relatively high temperatures encountered in high speed industrial sewing operations, particularly in the sewing of relatively heavy weight fabrics.

In accordance with the present invention a synthetic sewing thread of multifilament construction has been provided which is characterized by its ability to lessen the buildup of heat at the needle of a high speed sewing machine during the operation thereof, even during the sewing of relatively heavy weight fabrics, so as to allow the thread to be utilized as a substitute for the sewing threads heretofore required in high temperature sewing applications, such as cotton spun yarns or cotton sheathed core yarns. The sewing thread of this invention comprises a plurality of texturized continuous synthetic filaments, the filaments having a nonlinear crimped configuration providing bulk to the thread and being entangled with one another along the length of the thread and further bound together by twist, and the thread having a heat protective lubricant coating applied thereto and penetrating the filament bundle.

Sewing threads in accordance with the present invention typically range in size from 70 to about 800 denier and may be of a singles or plied construction. The lubricant coating is preferably a non-volatile liquid at room temperature and having a viscosity of about 90 to 250 cps. at 70° F. The preferred lubricant formulation is applied as a neat liquid and comprises silicone, polyethylene and a lubricant oil.

A particularly preferred thread construction in accordance with the invention comprises a synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said thread comprising a plurality of false twist texturized continuous synthetic filaments, said filaments each having a random nonlinear crimped configuration providing bulk to the thread and being randomly entangled with one another along the length of the thread, said thread having a twist of from about 1 to about 6 turns per inch serving to further bind together the filament bundle and having a coating of about 3 to about 11 percent by weight of a heat protective liquid lubricant coating comprising silicone, polyethylene and a lubricant oil.

In producing the sewing threads of this invention, one or more continuous multifilament synthetic yarns are treated with a particular mechanical treatment and with a special protective lubricant coating which imparts to the yarn the properties needed to effectively serve as a sewing thread in demanding high temperature applications. More specifically, the thread is produced by texturizing at least one continuous synthetic multifilament yarn to impart a nonlinear crimped configuration to the individual filaments thereof, directing said at least one yarn through a fluid jet and entangling the individual filaments with one another along the length of the yarn, imparting twist to said at least one yarn to further bind together the individual filaments, and applying to the thus processed yarn a heat protective lubricant coating.

DETAILED DESCRIPTION

Sewing threads in accordance with the present invention are produced from one or more continuous multifilament yarns, made for example from a synthetic thermoplastic material such as nylon or polyester. The yarn is first texturized to impart a random nonlinear crimp to the individual filaments, and to thereby produce bulk to the yarn so that the individual filaments are physically separated from one another and disposed in a nonparallel deregistered arrangement due to the random crimp present in the filaments.

The texturizing of the yarn can be carried out by processes well known in the art, such as for example by false twist texturizing, which is the preferred texturizing process for this invention. As is well known, false twist texturizing involves continuously passing the yarn through a twisting zone and imparting high twist to the yarn in one direction, heat setting the yarn while in the twisted condition, and then untwisting the yarn. Those skilled in this art are capable of selecting the appropriate processing conditions for the particular size and composition of yarn being processed so as to obtain a bulked yarn of the type described herein wherein the individual filaments thereof possess nonlinear crimp.

Following texturizing, the individual filaments are entangled with one another by passing through an air jet. The air jet serves to entangle and interlock the individual filaments, forming a coherent bundle of filaments which prevents individual filaments from being separated from the filament bundle to present a fuzzy appearance to the yarn. The entanglement and interlocking of the filaments also serves to maintain a diffused appearance to the yarn rather than the shiny appearance normally characteristic of continuous filaments, by preventing the filaments from being aligned parallel to one another. The air jet entanglement process may be carried out using entanglement jets of a construction known in the art, as for example described in U.S. Pat. No. 3,110,151. When a singles yarn is produced, the single end is directed through the air jet. In producing a plied yarn, two or more ends are brought together and passed through the air jet together so that the filaments of each yarn are entangled with one another and with filaments of the other yarn or yarns to form a unitary filament bundle. The air jet is preferably operated with compressed air at a rate of about 1 to 6 cubic feet per minute.

Preferably, the yarn is subsequently twisted to further bind together the individual filaments into a unitary bundle, with a twist within the range of about 1 to 6 turns per inch being imparted to the yarn. When the texturizing operation leaves residual torque present in the yarn, the twisting is preferably in a direction opposite to the torque to thereby obtain a substantially balanced and more nearly torque-free thread.

The protective lubricant coating is especially formulated to lower the frictional properties of the sewing thread and to lubricate and cool the needle, thus enabling the sewing thread to run at significantly lower temperatures than heretofore possible. The cooler running characteristic of the sewing thread of this invention enables it to perform exceptionally well even in the most severe applications, such as in the high speed industrial sewing of several plies of relatively heavy bottom weight fabric having a weight of 8 ounces per square yard or greater. The protective lubricant composition is characterized by having excellent thermal stability at temperatures of about 350 to 400 degrees F. By thermal stability, we mean that under conditions of heat, the composition does not oxidize, become sticky or otherwise change chemically. The composition is a non-volatile liquid at room temperature and remains liquid at temperatures up to about 300° F. Under the extreme elevated temperature conditions at the sewing needle, it is believed that the lubricant composition volatilizes, at least in part, thus contributing to the cooling of the needle. The lubricant is further characterized by having a relatively high heat capacity which enables it to receive and retain a large amount of heat energy during the sewing operation so as to thereby protectively shield the synthetic filaments from heat degradation or melting.

Lubricants conventionally used on sewing threads are typically solid wax-based compositions and must be applied in a heated molten condition at relatively heavy application rates, e.g. about 15 percent by weight. This class of lubricant composition prevents difficulty in obtaining uniform application and complete penetration since the lubricant composition tends to cool and harden on the surface of the yarn and often on only one side thereof. Unlike these conventional sewing thread lubricants, the lubricant coating of this invention is a liquid at normal room temperature and is applied to the yarn by conventional methods of application, such as a kiss roll applicator. The liquid composition completely penetrates and uniformly coats the filament bundle. Also unlike many of the sewing thread lubricant compositions used commercially, which have a critical narrow tolerance for the amount of lubricant coating on the yarn, the protective lubricant coating formulation of this invention has a relatively broad tolerance for the amount of the composition on the yarn. The coating composition is preferably applied at a level within the range of about 3 to about 15 percent by weight.

The viscosity of the coating formulation is sufficiently low to enable it to uniformly coat and penetrate the bundle of filaments, but is not so low that it would sling off the thread during winding operations. Preferably, the viscosity of the formulation is maintained within the range of about 90 to about 250 cps at 70 degrees F. The constituents of the lubricant coaring are non-volatile at room temperature, and the coating is applied to the thread as a neat liquid, i.e. without the use of diluents.

The primary constituent of the lubricant formulation is a liquid lubricant oil which is non-volatile at room temperature. Suitable lubricant oils may be selected from petroleum lubricating oils, lubricating oils derived from coal, synthetic lubricating oils, and mixtures of the above. Examples of synthetic lubricating oils include alkylene polymers, alkylene oxide polymers, esters of alkylene oxide polymers, esters of dicarboxylic acids, polyethers prepared from alkylene gycols, and fatty acid esters. The particular grade, composition and viscosity characteristics of the oil can be varied as needed in order to provide the overall formulation with a viscosity within the range noted above, and to this end it may be desirable to blend two or more lubricant oils of different viscosity characteristics. There are a number of commercially available lubricant oils which have been developed and marketed for use as yarn lubricants. These are generally either pure refined mineral oils or mixtures thereof with various additives, such as synthetic esters. Examples of commercially available lubricant oils suitable for use as yarn lubricants include Stantex 5050 or Stantex 5252, both products of Standard Chemical Products, and Lurol 1074A, a product of George A. Goulston Co.

Especially good results are achieved by including in the lubricant oil blend a relatively high viscosity polyisobutylene additive. This product has extremely low frictional properties and is marketed mainly as a low friction additive to motor oils. One such additive is marketed by A-Line Products of Detroit, Mich. under the designation PIO. This is a clear non-combustible non-flammable hydrofined oil having a density of 6.94 lb/gal. at 60° F., and a viscosity of 10,600 SSU at 210° F. Desirably, this additive is blended with the other oil components at a ratio of about 1:3 to about 1:6.

The protective lubricant composition also includes a silicone lubricant. Silicones are generally known for their lubricating properties and heat resistance, and various silicones are available commercially for use as thread lubricants. Typically the silicone compounds which have been developed as yarn lubricants are polymers or copolymers of dimethylsiloxane, and are generally available as clear or hazy white non-volatile oily liquids having a high flash point (usually above 400° F.). These liquids are available in a wide range of viscosity grades. The silicone liquids suitable for use in the present invention desirably have a nominal viscosity of about 10 to 300 centistokes. Examples of commercially available polydimethylsiloxane silicone fluids which may be used in the protective lubricant formulation of this invention include General Electric Silicone Fluid SF 96 or SF 97 and Dow Corning 200 Silicone Fluids.

The protective lubricant composition also includes a polyolefin, preferably a polyethylene of the emulsifible type. This class of polyethylene homopolymers and copolymers have been developed primarily for use on fabrics as an additive to permanent press resins or other finishing agents, and are intended for application in a water emulsion with the other finishing agents or resins. Examples of suitable commercially available polyethylenes include Allied Chemical is A-C series of polyethylenes.

In the protective lubricant composition of the present invention, polyethylene is mixed with the silicone and lubricant oil and serves to hold these normally incompatible constituents together as a stable liquid suitable for direct application without solvent or other diluent by conventional means, such as a kiss roll. The polyethylene also provides lubricity as well as serving to cool the sewing needle.

In formulating the lubricant composition, all of the components with the exception of the polyethylene are poured together and heated to about 180° F. degrees with agitation, following which the polyethylene is slowly added under strong agitation with continuous heating until the polyethylene is dissolved completely. Once all of the constituents are dissolved, heating is discontinued and the solution is cooled to room temperature.

The preferred protective lubricant composition for use in the present invention consists essentially of about 5 to 20 percent silicone, about 2 to 8 percent by weight polyethylene, and the balance lubricant oil.

The following examples are intended to illustrate to those skilled in the art how to practice the invention and the results obtained thereby. These examples are not intended to be understood as limiting the invention.

EXAMPLE 1

Two ends of 215 denier 24 filament polyester yarn produced by Tennessee Eastman are texturized on an ARCT double heater false twisting texturizing machine. The percent overfeed of the first and second roll is within the range of about −2% to about +4%, and the percent overfeed of the second to third roll is within the range of about +4% to 12%. About 48 to 52 twists per inch are inserted in the yarn in the twisting zone. The two ends are combined and pass through an air jet just prior to take-up. The air jet is operated with about 1 to 6 cubic feet per minute of compressed air. In a subsequent twisting operation, about one to six turns per inch of ply twist is inserted in the yarn. The yarn is directed across a kiss roll finish applicator and about 3 to 15 percent by weight of a protective lubricant coating composition is applied to the yarn.

EXAMPLE 2

High temperature sewing evaluation tests were performed on sewing threads that contained varying lubricant coating compositions and varying amounts of the lubricant coatings.

For each yarn the percent oil on the yarn was determined by Soxhlet extraction in freon. The sewing test consisted of sewing sixty inches on two, three and four plies of fourteen ounce denim at 5400 stitches per minute using a Model 56500J Flat-bed sewing machine with a Union Special GAS Type 128 size 100/040 needle. The needle temperature was measured on a Hatra Sew Infrared Sewability Tester. The test results are set forth in Table 1 below.

These tests showed that the needle temperature was related to the percent oil applied to the yarn. With the conventional mineral oil formulation (samples 23–26) an average maximum temperature of 330 degrees F. was obtained with 11.8 percent oil, compared to 430 degrees F. with 4.77 percent oil, on four layers of denim. Howeve, at the higher levels of lubricant on the yarn, there is a significant increase in smoke generated from the needle heat. The higher lubricant levels also present problems with staining on lightweight fabrics and with slinging during winding.

With the preferred lubricant formulations of the inventions (samples 1–21) significantly lower temperatures were obtained with considerably less amounts of lubricant present. For example, sample 13 averaged 332° F. on four layers with only 3.16 percent oil, as compared to sample 26 at 330° F. with 11.8 percent mineral oil.

The preferred lubricant formulations of the invention produced significantly lower needle temperature than the spun polyester control yarn.

TABLE I

| Sample | Lubricant Formula | % Lubricant on yarn | Viscosity (cps) | Temperature (°F.) 2 | 3 (plies) | 4 |
|---|---|---|---|---|---|---|
| 1 | A | 5.53 | 35 | 222 | 279 | 338 |
| 2 | A | 5.41 | 35 | 228 | 280 | 338 |
| 3 | A | 6.85 | 35 | 203 | 262 | 322 |
| 4 | B | 7.74 | 30 | 226 | 282 | 325 |
| 5 | B | 7.64 | 30 | 220 | 262 | 308 |
| 6 | C | 5.34 | 46 | 212 | 254 | 296 |
| 7 | C | 5.42 | 46 | 212 | 256 | 298 |
| 8 | D | 5.23 | 70 | 224 | 248 | 286 |
| 9 | D | 5.39 | 70 | 204 | 254 | 290 |
| 10 | E | 6.74 | 42 | 203 | 254 | 270 |

TABLE I-continued

| | | | | | | |
|---|---|---|---|---|---|---|
| 11 | E | 6.52 | 42 | 198 | 246 | 262 |
| 12 | E | 2.92 | | 232 | 302 | 336 |
| 13 | E | 3.16 | | 278 | 308 | 332 |
| 14 | E | 3.03 | | 236 | 322 | 342 |
| 15 | E | 3.11 | | 318 | 342 | 382 |
| 16 | F | 5.79 | | 275 | 338 | 366 |
| 17 | F | 4.49 | | 256 | 334 | 358 |
| 18 | G | 5.13 | | 246 | 328 | 366 |
| 19 | G | 4.08 | | 246 | 320 | 362 |
| 20 | H | 5.06 | | 244 | 266 | 342 |
| 21 | H | 5.88 | | 240 | 302 | 342 |
| 22 | No Lubricant | 0 | | would not sew | | |
| 23 | Std. Mineral Oil | 4.77 | | 312 | 389 | 430 |
| 24 | Std. Mineral Oil | 4.99 | | 252 | 338 | 386 |
| 25 | Std. Mineral Oil | 9.27 | | 292 | 358 | 372 |
| 26 | Std. Mineral Oil | 11.80 | | 238 | 296 | 330 |
| 27 (Spun Polyester Control) | Std. Mineral Oil | 4.16 | | 332 | 415 | 436 |

| Lubricant Formulas | Total Oil | Silicone | Polyethylene |
|---|---|---|---|
| A | 95 | 5 | 0 |
| B | 85 | 15 | 0 |
| C | 90 | 5 | 5 |
| D | 85 | 5 | 10 |
| E | 80 | 15 | 5 |
| F | 79 | 15 | 6 |
| G | 92 | 5 | 3 |
| H | 77 | 20 | 3 |

It should be apparent that many changes and modifications can be made in the details described above with departing from the nature and spirit of this invention. It is to be understood, therefore, that the foregoing description and examples are merely exemplary and that the invention is not limited, except by the claims which follow.

That which is claimed is:

1. A synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said thread comprising at least one yarn having a plurality of crimped texturized continuous synthetic filaments, said crimped texturized filaments having a nonlinear crimped configuration providing bulk to the thread and being entangled with one another along the length of the thread and being further bound together by twist, and said thread having a heat protective lubricant coating applied thereto and penetrating the filament bundle.

2. A synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said thread comprising a plurality of continuous synthetic multifilament yarns, each of said yarns comprising a plurality of crimped texturized continuous synthetic filaments of a nonlinear crimped configuration providing bulk to the thread, the crimped textured filaments of each yarn being entangled with one another and with filaments of the other yarns, and said yarns being further bound together by ply twist, and said thread having a heat protective lubricant coating applied thereto and penetrating the filament bundle.

3. A sewing thread as set forth in claim 1 or 2 wherein said heat protective lubricant coating is a liquid having a viscosity at 70° F. of about 90 to 250 cps.

4. A sewing thread as set forth in claim 1 or 2 wherein said heat protective lubricant coating is a neat liquid comprising silicone, polyethylene and a lubricant oil.

5. A sewing thread as set forth in claim 4 wherein said heat protective lubricant coating comprises about 5 to 20 percent of said silicone, about 2 to 8 percent of said polyethylene, and the balance being said lubricant oil.

6. A synthetic sewing thread of continuous multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said thread comprising a plurality of false twist texturized continuous synthetic filaments, said filaments each having a random nonlinear crimped configuration providing bulk to the thread and being randomly entangled with one another along the length of the thread, said thread having a twist of from about 1 to about 6 turns per inch serving to further bind together the filament bundle and having a coating of about 3 to about 15 percent by weight of a heat protective liquid lubricant coating comprising silicone, polyethylene and a lubricant oil.

7. A seam comprising a plurality of plies of relatively heavy fabric of a weight of at least 8 ounces per square yard secured together by at least one row of stitching, and wherein said stitching is formed by at least one synthetic continuous multifilament sewing thread as set forth in any one of claims 1, 2 or 6.

8. A method for producing a synthetic sewing thread of multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said method comprising crimp texturizing at least one continuous synthetic multifilament strand to impart a nonlinear crimped configuration to the individual filaments thereof, directing the crimped textured strand through a fluid jet and entangling the individual filaments with one another along the length of the strand, imparting twist to the strand to further bind together the individual filaments, and applying to the thus processed strand a heat protective lubricant coating.

9. A method as set forth in claim 8 wherein said step of applying a heat protective lubricant coating comprises applying to the strand a neat liquid comprising silicone, polyethylene, and a lubricant oil.

10. A method as set forth in claim 9 wherein said coating comprises about 5 to 20 percent of said silicone, about 2 to 8 percent of said polyethylene, and the balance being said lubricant oil.

11. A method as set forth in claim 8 wherein said step of texturizing comprises false twist texturizing.

12. A method for producing a synthetic sewing thread of multifilament construction characterized by its ability to lessen the buildup of heat at the needle of a high speed sewing machine during the operation thereof, even during the sewing of relatively heavy weight fabrics, so as to allow the thread to be utilized as a substitute for the sewing threads conventionally required in high temperature sewing applications, such as cotton spun yarns or cotton sheathed core yarns, said method comprising false twist texturizing at least one continuous synthetic multifilament strand to impart a nonlinear crimped configuration to the individual filaments thereof, directing said at least one strand through an air jet and entangling the individual filaments with one another along the length of the strand, imparting a twist of from about 1 to about 6 turns per inch to said at least one strand to further bind together the individual filaments, and applying to the thus processed strand about 3 to about 15 percent by weight of a heat protective liquid lubricant coating comprising silicone, polyethylene, and a lubricant oil.

* * * * *